US010221611B2

(12) United States Patent
Kim

(10) Patent No.: US 10,221,611 B2
(45) Date of Patent: Mar. 5, 2019

(54) WINDOW FRAME INSULATION METHOD FOR CONSTRUCTING WARM HOUSE

(71) Applicant: STARVILLENGINEERING CO., LTD., Sejong-si (KR)

(72) Inventor: Woong-Hoi Kim, Daejeon (KR)

(73) Assignee: STARVILLENGINEERING CO., LTD. (KR)

( * ) Notice: Subject to any disclaimer, the term of this patent is extended or adjusted under 35 U.S.C. 154(b) by 0 days.

(21) Appl. No.: 15/624,215

(22) Filed: Jun. 15, 2017

(65) Prior Publication Data

US 2017/0284151 A1 Oct. 5, 2017

Related U.S. Application Data

(63) Continuation of application No. PCT/KR2015/006299, filed on Jun. 22, 2015.

(30) Foreign Application Priority Data

Mar. 4, 2015 (KR) ..... 10-2015-0030198

(51) Int. Cl.
*E06B 1/36* (2006.01)
*E04B 1/76* (2006.01)
(Continued)

(52) U.S. Cl.
CPC ..... *E06B 1/36* (2013.01); *E04B 1/16* (2013.01); *E04B 1/76* (2013.01); *E04B 1/7641* (2013.01);
(Continued)

(58) Field of Classification Search
CPC ..... E06B 1/68; E06B 1/62; E06B 1/35; E06B 3/30; E04B 2001/2442; E04B 1/2403; E04B 1/24; E04B 1/92; E04C 5/162
See application file for complete search history.

(56) References Cited

U.S. PATENT DOCUMENTS 1,537,318 A * 5/1925 Lipstreuer ..... E06B 1/24 52/187
4,341,831 A * 7/1982 Kleiss ..... C08J 5/124 156/313
(Continued)

FOREIGN PATENT DOCUMENTS

KR 10-2012-0040006 A 4/2012
KR 10-2012-0109095 A 10/2012
(Continued)

OTHER PUBLICATIONS

Korean Office Action (KR 10-2015-0030198), KIPO, dated Mar. 31, 2015.
(Continued)

*Primary Examiner* — Phi D A
(74) *Attorney, Agent, or Firm* — Park & Associates IP Law, P.C.

(57) ABSTRACT

A window frame insulation method for constructing a warm house of the present invention, provided in order to achieve the above objective, comprises: a placement preparation step (S10) for opening a portion of a wall body so as to insert a window frame before the wall body is formed, and forming a mold so as to form a stepped portion on the outer side of the wall body; a placement step (S20) for placing concrete so as to form the wall body within the mold; a preservation step (S30) for conservation of the concrete formed within the mold in order to prevent harmful effects; a window frame installment step (S40) for installing a window frame on the inner side of the opened wall body; an insulation material installment step (S50) for installing insulation material in the wall body except for the window frame; and a finishing material installment step (S60) for installing finishing material on the outer side of an outer insulation material.

1 Claim, 8 Drawing Sheets

(51) Int. Cl.

| | |
|---|---|
| ***E04B 1/16*** | (2006.01) |
| ***E04B 2/84*** | (2006.01) |
| ***E04G 15/02*** | (2006.01) |
| *E04G 9/10* | (2006.01) |

(52) U.S. Cl.
CPC ..... *E04B 2/84* (2013.01); *E04G 15/02* (2013.01); *E04G 9/10* (2013.01)

(56) References Cited

U.S. PATENT DOCUMENTS 4,492,062 A * 1/1985 Levenez ..... E06B 1/705 52/209
5,687,540 A * 11/1997 Thomas ..... E06B 1/00 49/504
7,587,868 B2 * 9/2009 Hughes ..... E04G 15/02 52/205
8,495,843 B1 * 7/2013 Horneland ..... E06B 1/003 52/215
8,833,035 B2 * 9/2014 Vos ..... E06B 1/62 49/408
2009/0255196 A1 * 10/2009 Nirel ..... E06B 1/02 52/204.53
2010/0139178 A1 * 6/2010 Ehrman ..... B32B 5/08 52/58
2010/0319285 A1 * 12/2010 Jewett ..... E04B 1/161 52/309.4
2011/0041431 A1 * 2/2011 McKenna ..... E06B 1/6015 52/204.1
2011/0296777 A1 * 12/2011 Matta ..... E06B 1/342 52/208
2011/0314766 A1 * 12/2011 Alvarado ..... E06B 1/02 52/745.15
2012/0047816 A1 * 3/2012 Zhong ..... E04B 1/161 52/11
2012/0222383 A1 * 9/2012 Cashman ..... E04F 13/06 52/717.01
2012/0233936 A1 * 9/2012 Zhong ..... E04B 1/165 52/173.1
2014/0000204 A1 * 1/2014 Wu ..... E04B 1/7629 52/506.05
2015/0240483 A1 * 8/2015 Riepe ..... E04B 1/7604 52/309.12
2017/0022699 A1 * 1/2017 Lim ..... E04C 2/296

FOREIGN PATENT DOCUMENTS

KR 10-2013-0025695 A 3/2013
KR 101508960 B1 * 4/2015
WO WO-0188318 A1 * 11/2001 ..... E06B 1/02

OTHER PUBLICATIONS

International Search Report (PCT/KR2015/006299), WIPO, dated Jul. 23, 2015.

* cited by examiner

WINDOW FRAME INSULATION METHOD FOR CONSTRUCTING WARM HOUSE

REFERENCE TO RELATED APPLICATIONS

This is a continuation of pending International Patent Application PCT/KR2015/006299 filed on Jun. 22, 2015, which designates the United States and claims priority of Korean Patent Application No. 10-201 5-00301 98 filed on Mar. 04, 2015, the entire contents of which are incorporated herein by reference.

FIELD OF THE INVENTION

The present invention relates to a window frame insulation method for constructing a warm house, and more particularly to a window frame insulation method for constructing a warm house, which is capable of preventing heat loss from occurring around a window frame by installing an insulation material to an opening in a wall and subsequently installing an exterior sheathing material to the wall.

BACKGROUND OF THE INVENTION

In general, a window is a space in the wall or the roof of a building, which has glass in it so that air or sunlight can enter and a user can see out.

When a wall is constructed, a portion of the wall is formed so as to be open by placing concrete or laying bricks after first securing a space in which a window frame for installation of a window is installed.

FIG. 1 is a plan view illustrating a general structure in which an exterior insulation material is installed around a window frame on an outer wall of a building.

As shown in FIG. 1, in most cases, an exterior insulation material is installed in a manner such that a window frame 40 and a window 50 are first installed in a wall 10 and an exterior insulation material 20 and an exterior sheathing material 30 are installed on the outer side of the wall.

In order to maintain the indoor temperature constant, the exterior insulation material 20 must be installed between the wall 10 and the exterior sheathing material 30, whereby it is possible to effectively prevent heat loss between an indoor area and an outdoor area, and if the exterior insulation material 20 is exposed to external air, convection heat transfer, in which the heat transfer rate is high, occurs, and consequently heat loss is increased.

However, when the exterior insulation material 20 is installed to the wall 10, as shown in FIG. 1, the exterior insulation material 20 cannot cover the edge of the opening in the wall 10, in which the window frame 40 is installed, and only the exterior sheathing material 30 covers the edge of the opening in the wall 10.

In this case, there is a problem in which heat transfer and resultant heat loss occur more actively in the region of the wall 10 that is not covered with the exterior insulation material 20 than in the region of the wall 10 that is covered with the exterior insulation material 20.

In order to solve this problem, a heat transfer cutoff structure of a window for a building is disclosed in Korean Patent Laid-Open Publication No. 10-2012-0061461, which includes a concrete wall forming an outer wall surface of a building, a window unit installed through the concrete wall, and a heat transfer cutoff member interposed between a sash frame of the window unit and the concrete wall and having a predetermined thickness capable of lowering heat conductivity therebetween, whereby the sash frame of the window unit and the concrete wall are not in direct contact with each other due to the heat transfer cutoff member interposed therebetween, which has the effect of improving the insulation performance of the building.

However, in the above-described prior art, because the heat transfer cutoff member is installed to the opening in the wall and the window frame is installed to the heat transfer cutoff member, there is an inconvenience in that it is difficult to accurately determine the dimensions of the opening in the wall when the same is formed.

Further, in the above-described prior art, because the heat transfer cutoff member must be interposed between the window frame and the wall surface, there is inconvenience in that manufacturing costs are increased and the construction thereof takes a long time.

SUMMARY OF THE INVENTION

An object of the present invention to solve the above problems is to provide a window frame insulation method for constructing a warm house, which is capable of effectively reducing the occurrence of heat loss by installing an exterior insulation material over the entire outer side of a wall having an opening formed therein.

Another object of the present invention is to provide a window frame insulation method for constructing a warm house, which is capable of reducing the cost of heating or air-conditioning by additionally installing an insulation material in the wall so as to maintain a constant indoor temperature.

A further object of the present invention is to provide a window frame insulation method for constructing a warm house, which enables simple and less expensive construction.

In accordance with an aspect of the present invention, the above and other objects can be accomplished by the provision of a window frame insulation method for constructing a warm house, the method including preparing placement in which an opening is formed in a portion of a wall so as to insert a window frame thereinto before the wall is formed and a mold is fabricated so as to form a stepped portion in an outer side of the wall, placing concrete in the mold in order to form the wall, curing the concrete to protect the concrete placed in the mold from harmful influence, installing a window frame to an inner side of the opening in the wall, installing an insulation material to the wall excluding the window frame, and installing a sheathing material to an outer side of the installed insulation material.

In addition, according to the window frame insulation method for constructing a warm house of the present invention, the stepped portion may be formed such that it is concave from an upper side and two lateral sides of the opening in an outward direction of the wall to an extent equivalent to a sum of a thickness of the insulation material and a thickness of the sheathing material and such that it has a depth that allows a stepped insulation material to be positioned further toward an indoor area than the window frame when the insulation material is installed to the window frame and the stepped portion.

In addition, according to the window frame insulation method for constructing a warm house of the present invention, the wall may be made of a material selected from among concrete, concrete blocks, ALC blocks and bricks.

In addition, according to the window frame insulation method for constructing a warm house of the present invention, when the wall is formed of concrete blocks, ALC blocks or bricks, the opening and the stepped portion in the wall may be formed in a manner such that mock-ups of the window frame and the stepped portion, made of a wood or plastic material, are temporarily installed and blocks or bricks are then laid.

In addition, according to the window frame insulation method for constructing a warm house of the present invention, the insulation material may be installed to an outer surface of the wall along the stepped portion formed in the wall and the sheathing material may be installed to the stepped portion so as to be perpendicular to the wall.

In addition, according to the window frame insulation method for constructing a warm house of the present invention, an insulation material may be inserted into the mold and concrete may then be placed into the mold so that the insulation material is disposed in the concrete.

As described above, according to the window frame insulation method for constructing a warm house of the present invention, there is an effect in that the occurrence of heat loss is effectively reduced by installing an exterior insulation material over the entire outer side of a wall having an opening formed therein.

In addition, according to the window frame insulation method for constructing a warm house of the present invention, there is an effect in that the cost of heating or air-conditioning is reduced by additionally installing an insulation material in the wall so as to maintain a constant indoor temperature.

In addition, according to the window frame insulation method for constructing a warm house of the present invention, there is an effect in that the construction is simple and costs less.

Figure 1:
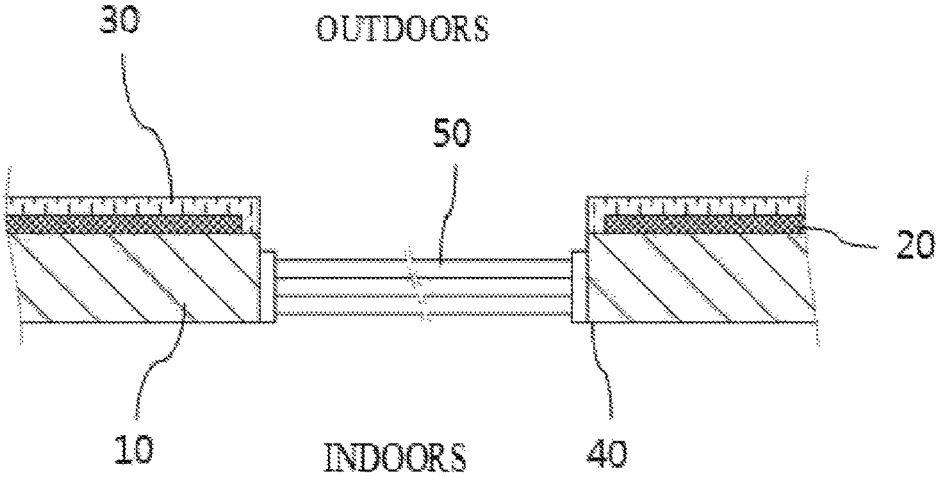
FIG. 1 is a plan view illustrating a general structure in which an exterior insulation material is installed around a window frame on an outer wall of a building.

| Description of Reference Numerals | |
|---|---|
| 10: wall | 20: exterior insulation material |
| 30: exterior sheathing material | 40: window frame |
| 50: window | 100: wall |
| 200: exterior insulation material | 210: stepped insulation material |
| 300: exterior sheathing material | 310: stepped sheathing material |
| 400: window frame | 500: window sill |
| 600: mold | |

DETAILED DESCRIPTION OF THE INVENTION

The features and advantages of the present invention will be described below in detail with reference to the accompanying drawings. In the following description of the present invention, a detailed description of known functions and configurations incorporated herein will be omitted when it may obscure the subject matter of the present invention.

The present invention relates to a window frame insulation method for constructing a warm house, and more particularly to a window frame insulation method for constructing a warm house, which is capable of preventing heat loss from occurring around a window frame by installing an insulation material to an opening in a wall and subsequently installing an exterior sheathing material to the wall.

Hereinafter, preferred embodiments of the present invention will be described in detail with reference to the accompanying drawings.

Figure 2:
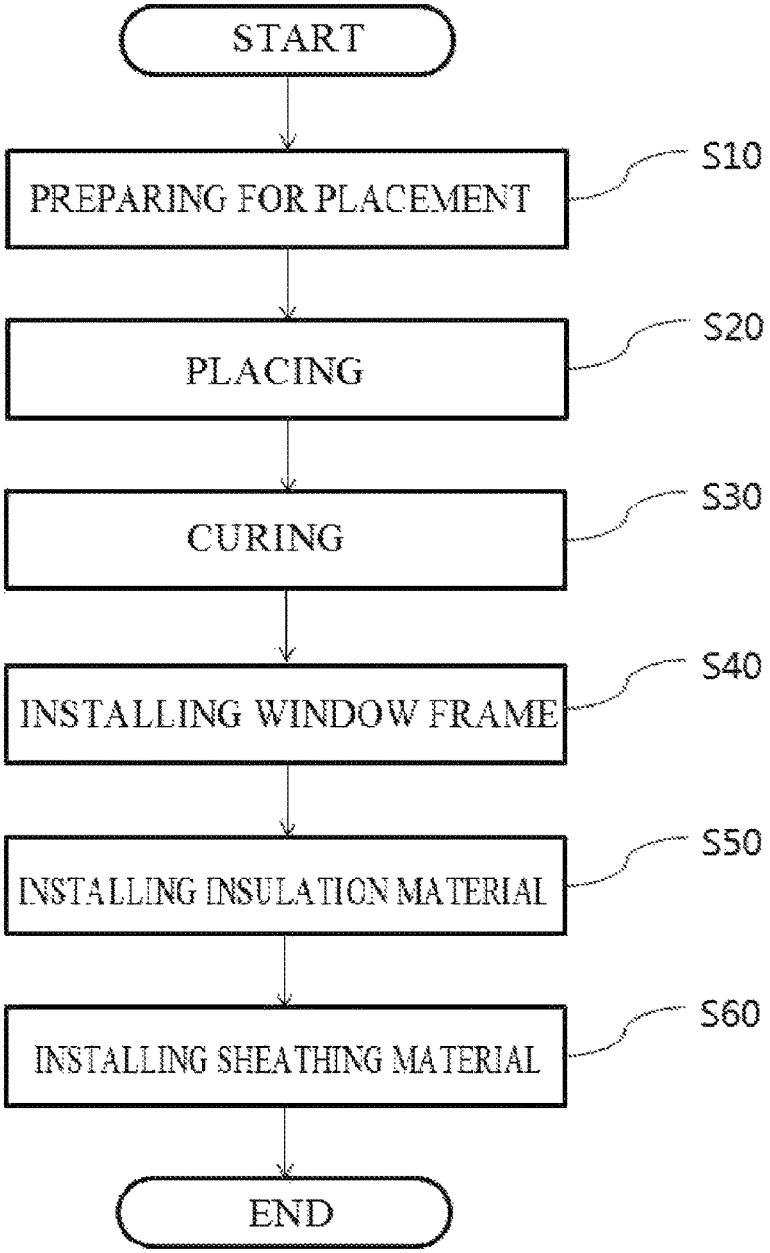
FIG. 2 is a flowchart showing the steps of a window frame insulation method for constructing a warm house according to the present invention.

FIG. 2 is a flowchart showing the steps of a window frame insulation method for constructing a warm house according to the present invention, and as shown in FIG. 2, a window frame 400 insulation method for constructing a warm house of the present invention includes a placement preparation step (S10) of forming an opening in a portion of a wall 100 so as to insert a window frame 400 thereinto before the wall 100 is formed and fabricating a mold 600 so as to form a stepped portion in the outer side of the wall 100, a placement step (S20) of placing concrete in the mold 600 in order to form the wall 100, a curing step (S30) of protecting the concrete placed in the mold 600 from damage, a window frame 400 installation step of installing a window frame 400 to the inner side of the opening in the wall 100, an insulation material installation step (S50) of installing an insulation material to the wall 100 excluding the window frame 400, and a sheathing material installation step (S60) of installing a sheathing material to the outer side of the exterior insulation material 200.

Figure 3:
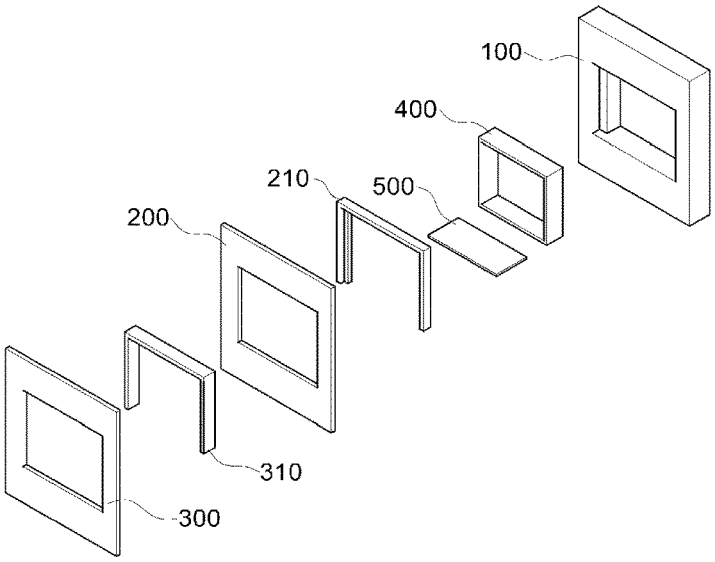
FIG. 3 is a perspective view illustrating the sequential arrangement of elements that are installed to an opening in a wall in accordance with the window frame insulation method for constructing a warm house according to the present invention.

FIG. 3 is a perspective view illustrating the sequential arrangement of elements that are installed to the opening in the wall in accordance with the window frame insulation method for constructing a warm house according to the present invention, and as shown in FIG. 3, the placement preparation step (S10) is a step for determining the shape and the thickness of the wall 100 before placing the concrete to form the wall 100 and for securing a space for installation of the window frame 400 therein by forming an opening in a portion of the wall 100 so that the air in the room can go out and sunlight can enter the room.

Because the wall 100, which defines the exterior of a building, structurally receives a load from the above and transfers the load to the foundation, it must be designed so as to have sufficient strength to endure this load, as well as a lateral load attributable to wind or an earthquake.

Further, because concrete has low tensile strength, concrete-reinforcing bars are installed before placement of the concrete, and the reinforcing bars are formed such that the ends thereof are bent or formed in a loop shape so as to prevent the bars from being pulled out even when tensile force is applied thereto, and are embodied as deformed reinforcing bars that have a patterned surface.

In order to perform the placement of the concrete after the installation of the reinforcing bars, the mold 600 is built so as to surround the reinforcing bars and to define a space having a thickness equivalent to the designed thickness of the wall and an open upper side through which the concrete is placed into the mold 600.

Figure 9:
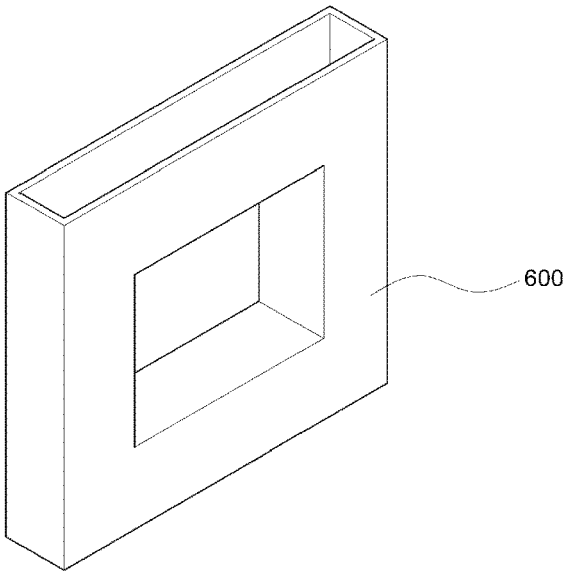
FIG. 9 is a perspective view illustrating a mold made in accordance with the window frame insulation method for constructing a warm house according to the present invention.

FIG. 9 is a perspective view illustrating the mold 600 made in accordance with the window frame insulation method for constructing a warm house according to the present invention, and as shown in FIG. 9, the wall 100, to which the window frame 400 is installed, has an opening formed therein so as to have a size equivalent to the size of the window frame 400, and the opening in the wall has an extra space defined therein so as to have a size equivalent to the thickness of a window sill 500 so that the window sill 500 can be interposed between the bottom of the window frame 400 and the bottom of the opening in the wall.

In addition, the mold 600 is formed in a sealed type so as to prevent the concrete placed therein from leaking to the opening in the wall, excluding the upper side thereof, which is open to allow the placement of the concrete therein.

Figure 10:
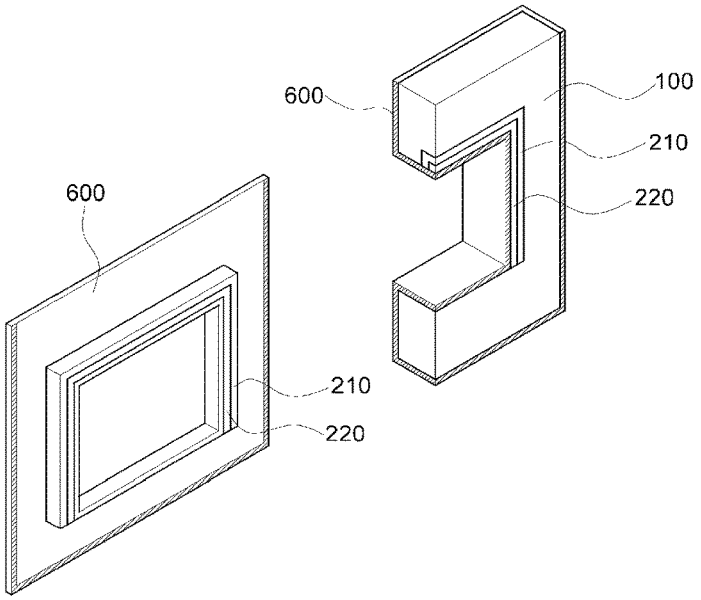
FIG. 10 is a perspective view illustrating the section of the interior of the mold and the state in which concrete is placed in accordance with the window frame insulation method for constructing a warm house according to the present invention.

FIG. 10 is a perspective view illustrating the section of the interior of the mold 600 and the state in which the concrete is placed in accordance with the window frame insulation method for constructing a warm house according to the present invention, and as shown in FIG. 10, in order to install an insulation material over the entire area of the wall 100 formed of concrete, a stepped insulation material 210 is installed in the mold so that a portion of the opening in the wall is formed to be stepped from the outdoor area toward the indoor area. The stepped portion is formed only in the upper side and the two lateral sides of the opening, and the lower side of the opening is formed flat without a stepped portion.

The stepped insulation material 210 is formed by cutting off a portion from a rectangular-shaped insulation material so as to have an L-shaped section, and the cut-off portion is used as a covering material 220, which is attached to the stepped insulation material 210 using an adhesive or a piece of double-sided adhesive tape.

In order to prevent the stepped insulation material 210 from being damaged due to the load of the concrete that is placed as shown in FIG. 10, a safety film or a non-woven fabric material may be installed to the surface of the stepped insulation material 210 that is bonded to the concrete.

The stepped insulation material 210 is attached to the mold 600 using an adhesive or a piece of double-sided adhesive tape so as to prevent deviation in the position thereof, and subsequently the concrete is placed and cured.

The stepped portion may be formed in a manner such that, instead of the stepped insulation material 210, mock-ups of the window frame 400 and the stepped portion, which are made of a wood or plastic material, are installed in the mold 600 and concrete is then placed in the mold.

At this time, the stepped portion is formed such that it is concave from the upper side and the two lateral sides of the opening in the outward direction of the wall 100 to an extent equivalent to the sum of the thickness of the insulation material and the thickness of the sheathing material and such that it has a depth that allows the stepped insulation material 210 to be positioned further toward the indoor area than the window frame 400 when the insulation material is installed to the window frame 400 and the stepped portion.

The placement step (S20) is a step of forming the wall 100 by placing concrete in the mold 600 that is made in the placement preparation step (S10).

Concrete is placed in the mold 600, which is made in the shape of the wall 100, through the upper side of the mold 600 so as to be evenly spread from the bottom of the mold 600 to the top thereof, and the mold 600 is supported by load-supporting members such as support pipes until the curing is completed so as to prevent the mold 600 from collapsing due to the weight of the concrete placed therein.

The curing step (S30) is a step of sufficiently protecting and preserving the concrete that is completely placed so as to prevent the concrete from being negatively affected by, for example, temperature, load, shocks, contamination or damage.

Because concrete is vulnerable to damage for 3 days after placement, it is necessary to protect the same from shocks, and it is gradually hardened to nearly reach its ultimate compressive strength in 28 days. Because the chemical action of cement continues until that time, it is necessary to avoid direct sunlight, cold and heavy rain, and to maintain the humidity at a desired level by sprinkling water for 7 days or more in the hot season or usually for 5 days or more and to keep the concrete warm so that the temperature does not drop below 2° C. in the cold season by covering the same with matting, covering or the like so as to promote hydration of concrete.

Figure 11:
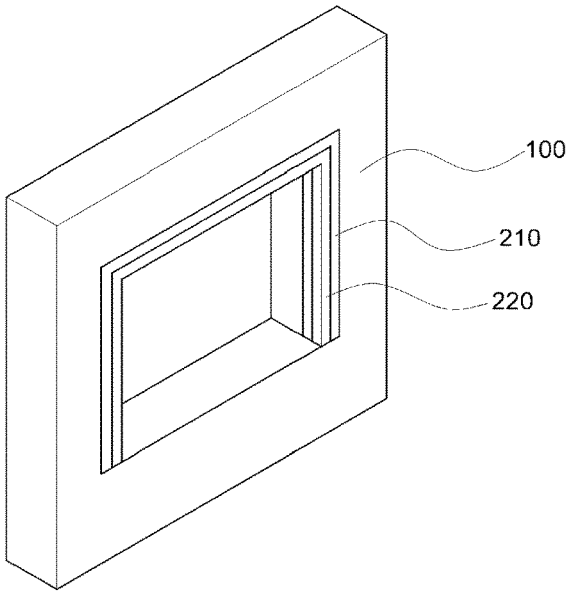
FIG. 11 is a perspective view illustrating the state in which the mold is removed after the concrete is completely cured in accordance with the window frame insulation method for constructing a warm house according to the present invention.

FIG. 11 is a perspective view illustrating the state in which the mold is removed after the concrete is completely cured in accordance with the window frame insulation method for constructing a warm house according to the present invention, and as shown in FIG. 11, the concrete wall 100 that has completely undergone the curing step (S30) has an opening formed therein and is provided with the stepped insulation material 210 and the covering material 220, which are attached to the upper side and the two lateral sides of the opening in the wall 100 that is oriented toward the outdoor area.

Figure 12:
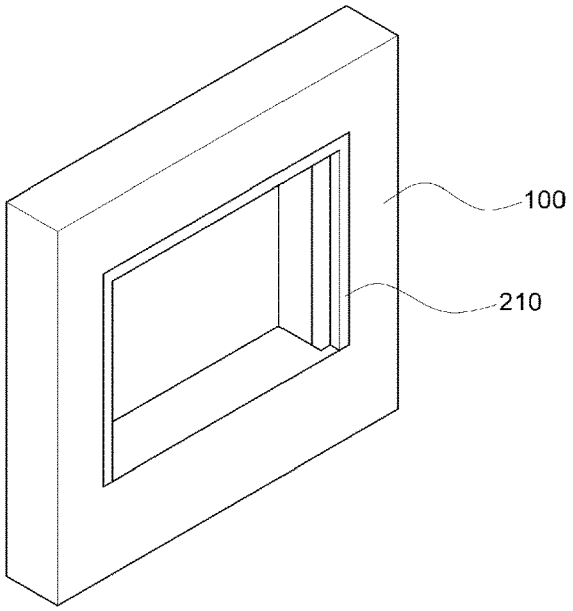
FIG. 12 is a perspective view illustrating the state in which a stepped portion is formed by removing a covering material from a stepped insulation material in accordance with the window frame insulation method for constructing a warm house according to the present invention.

FIG. 12 is a perspective view illustrating the state in which a stepped portion is formed by removing the covering material from the stepped insulation material in accordance with the window frame insulation method for constructing a warm house according to the present invention, and as shown in FIG. 12, when the cover material 220, which has been temporarily attached to the stepped insulation material to form a stepped portion, is removed, the stepped portion is formed.

The window frame 400 installation step is a step of installing the window frame 400 to the opening in the wall 100 formed after the completion of the curing step (S30) of the concrete, in which the window sill 500 is first installed to the bottom of the opening, the window frame 400 is installed onto the window sill 500, a gap between the concrete wall 100 and the window sill 500 is filled with urethane foam, and the window frame 400 is secured to the wall by means of plastering or silicon.

At this time, the window sill 500 protrudes toward the outdoor area further than an exterior sheathing material 300 so as to prevent rainwater flowing down from the window frame 400 from being discharged along the wall.

The insulation material installation step (S50) is a step of installing an insulation material to the outer surface of the concrete wall 100 so as to maintain the indoor temperature at a constant level by cutting off the inflow of heat from the outdoor area to the indoor area or the outflow of heat from the indoor area to the outdoor area.

In this disclosure, the insulation material is a generic term for the exterior insulation material 200, the interior insulation material (not shown) and the stepped insulation material 210, which are formed of the same material and are distinguished from each other on the basis of their installation positions.

The sheathing material installation step (S60) is a step of installing the sheathing material to protect the insulation material and improve the external appearance of a building, and the sheathing material may be granite, a glass curtain wall, paneling, clay brick, Dryvit, etc.

In this disclosure, the sheathing material is a generic term for the exterior sheathing material 300 and the stepped sheathing material 310, which are formed of the same material and are distinguished from each other on the basis of their installation positions.

Figure 13:
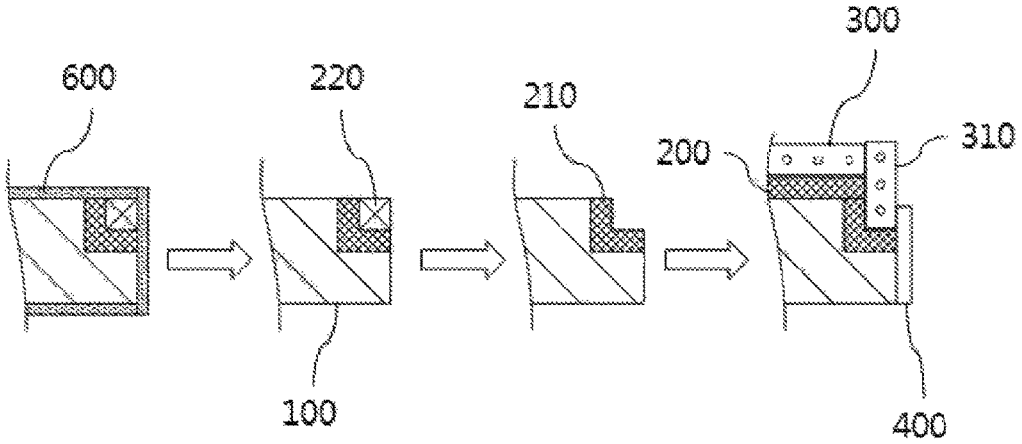
FIG. 13 is a process view illustrating the construction processes performed in accordance with the window frame insulation method for constructing a warm house according to the present invention.

FIG. 13 is a process view illustrating the construction processes performed in accordance with the window frame insulation method for constructing a warm house according to the present invention, and describing briefly the construction processes with reference to FIG. 13, the mold 600 is made to define the wall, the stepped insulation material 210, a portion of which is reinforced by the film, is installed in the mold 600, the covering material 220 is fitted in the stepped portion of the stepped insulation material 210, and concrete is placed in the mold. When the curing of the concrete is completed, the covering material 220 is removed from the stepped insulation material 210, the window frame 400 is installed so as to shield one side of the stepped insulation material 210, and the stepped sheathing material 310 is fitted into the stepped portion formed in the stepped insulation material 210 so as to be parallel to the window frame 400. At this time, the exterior insulation material 200 and the exterior sheathing material 300 are further installed onto the outer surface of the wall 100 so that the insulation material is installed over the entire area of the outer surface of the wall 100, thereby enhancing the insulation effect.

Figure 4:
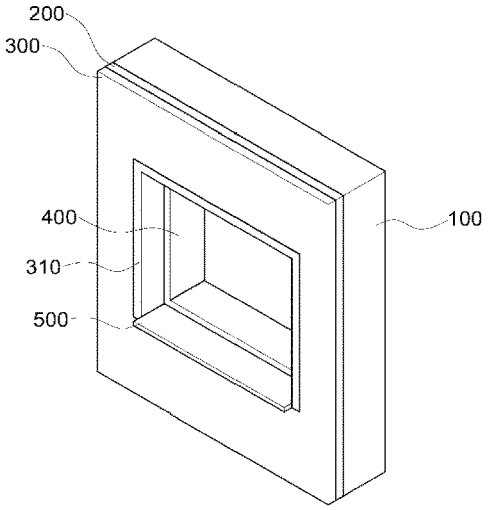
FIG. 4 is a perspective view illustrating the external appearance of the wall having the opening constructed in accordance with the window frame insulation method for constructing a warm house according to the present invention.

FIG. 4 is a perspective view illustrating the external appearance of the wall having the opening constructed in accordance with the window frame insulation method for constructing a warm house according to the present invention, and it can be seen in FIG. 4 that the stepped insulation material 210, the exterior insulation material 200, the stepped sheathing material 310 and the exterior sheathing material 300 are completely installed to the wall 100.

Figure 5:
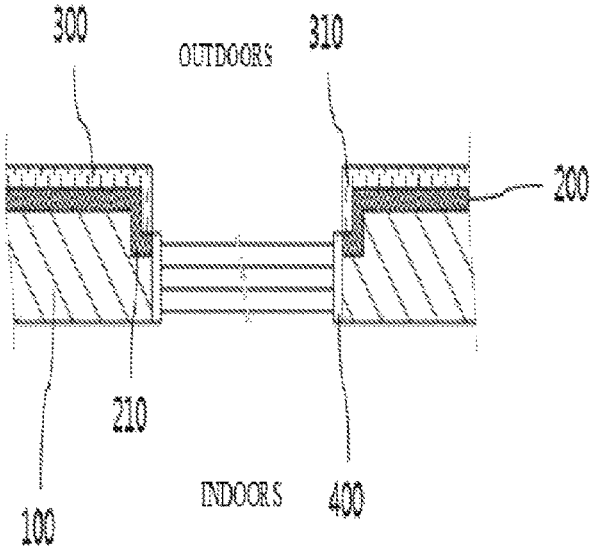
FIG. 5 is a plan view illustrating the wall constructed in accordance with the window frame insulation method for constructing a warm house according to the present invention when sectioned in the horizontal direction and viewed from above.

FIG. 5 is a plan view illustrating the wall constructed in accordance with the window frame insulation method for constructing a warm house according to the present invention when sectioned in the horizontal direction and viewed from above, and as shown in FIG. 5, the window frame 400 insulation method for constructing a warm house according to the present invention is characterized in that the insulation material is installed to the outer surface of the wall 100 along the stepped portion formed in the wall 100 and the sheathing material is installed to the stepped portion so as to be perpendicular to the wall 100.

Each of the two lateral sides of the opening in the wall 100, as shown in FIG. 5, has the stepped portion formed therein, and the stepped portion is formed such that it is concave from the upper side and the two lateral sides of the opening in the outward direction of the wall 100 to an extent equivalent to the sum of the thickness of the insulation material and the thickness of the sheathing material and such that it has a depth that allows the stepped insulation material 210 to be positioned further toward the indoor area than the window frame 400 when the insulation material is installed to the window frame 400 and the stepped portion.

Figure 6:
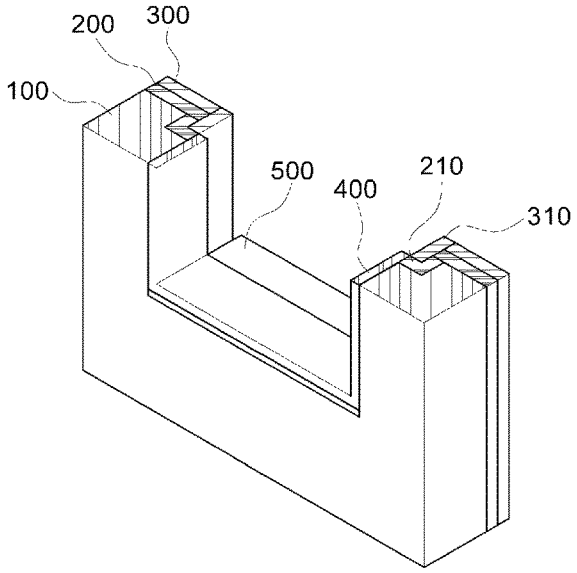
FIG. 6 is a perspective view illustrating the wall constructed in accordance with the window frame insulation method for constructing a warm house according to the present invention when sectioned in the horizontal direction.

FIG. 6 is a perspective view illustrating the wall constructed in accordance with the window frame insulation method for constructing a warm house according to the present invention when sectioned in the horizontal direction, and as shown in FIG. 6, when the exterior insulation material 200 is installed to the outer surface of the wall 100, the stepped insulation material 210 is mounted along the stepped portion formed in the opening in the wall 100, and the end of the stepped insulation material 210 is adhered to the side surface of the window frame 400 that protrudes further outward than the stepped portion.

The sheathing material serves to prevent the insulation material from being separated from the wall 100 or being damaged due to external impact and to improve the external appearance of the building, and is installed such that the stepped sheathing material 310, as shown in FIG. 5, is installed to the side surface of the window frame 400 so as to be parallel to the window frame 400 in order to protect the stepped insulation material 210 installed to the stepped portion and such that a gap between the window frame 400 and the stepped sheathing material 310 is caulked in order to prevent convective or radiative heat transfer from occurring in the insulation material.

Figure 7:
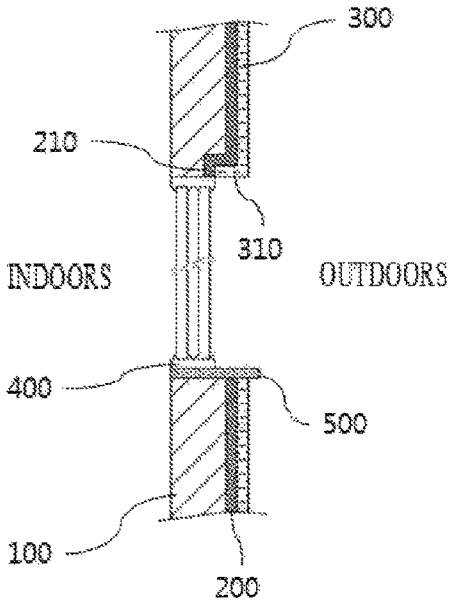
FIG. 7 is a side view illustrating the wall constructed in accordance with the window frame insulation method for constructing a warm house according to the present invention when sectioned in the vertical direction and viewed from the side.
Figure 8:
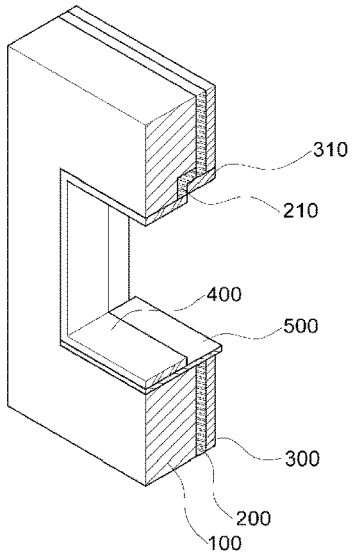
FIG. 8 is a perspective view illustrating the wall constructed in accordance with the window frame insulation method for constructing a warm house according to the present invention when sectioned in the vertical direction.

FIG. 7 is a side view illustrating the wall constructed in accordance with the window frame insulation method for constructing a warm house according to the present invention when sectioned in the vertical direction and viewed from the side, and as shown in FIG. 7, the top of the opening in the wall 100 has the stepped portion formed therein, and the bottom thereof is formed as a flat plane having no stepped portion.

The exterior insulation material 200 and the stepped insulation material 210 are installed to the stepped portion formed in the top of the opening in the same way as the two lateral sides thereof, and the exterior insulation material 200 and the exterior sheathing material 300 are installed below the opening after the window sill 500 is installed to the bottom of the opening.

The window sill 500 is a member for preventing outdoor water from permeating the indoor area, which is formed in a plate type made by processing metal or mineral such as a rock and is installed to the bottom of the opening. At this time, the window sill 500 may be formed to have an inclined portion and must be perfectly caulked in order to prevent water from flowing into the window frame 400 and the exterior sheathing material.

In addition, a stepped portion may also be formed below the window sill 500 in order to install the insulation material thereto, and in this case, the stepped portion may be formed in the same way as those formed in the upper side and the two lateral sides of the opening.

In addition to the insulation material installed to the outer region, an interior insulation material may be inserted into the concrete in order to further enhance the insulation performance.

In the placement preparation step (S10), an interior insulation material is inserted between two sides of the mold 600, which is formed in the shape of the wall 100, reinforcing bars are arranged in the interior insulation material and the mold 600, and concrete is placed in the mold 600 to form the wall 100.

Since the interior insulation material disposed in the concrete wall 100 and the exterior insulation material 200 together exhibit double the insulation performance, a significant loss of the heat, generated by heating operation in winter, to the outdoor area does not occur, thus maintaining a constant temperature, and inflow of heat from the outdoor area in summer is prevented, thus maintaining the cooling state for a long time, which has the effect of reducing costs.

Further, the wall 100 may be formed of a material other than concrete, for example, concrete blocks, ALC blocks or bricks, and in the case in which blocks or bricks are used to form the wall, the opening and the stepped portion may be formed in a manner such that mock-ups of the window frame 400 and the stepped portion, which are made of a wood or plastic material, are temporarily installed, and blocks or bricks are then laid.

At this time, the mock-ups are wrapped by an elastic material, such as sponge or foam synthetic rubber, which is easily compressed when a load is applied thereto, and is restored to its original shape when the load is released, and when the wall 100 is completely formed, the elastic material wrapping the mock-ups is first removed, and the mock-ups are easily removed using the space generated between the mock-ups and the wall 100.

As described above, the window frame insulation method for constructing a warm house according to the present invention has effects of the occurrence of heat loss being effectively reduced by installing an exterior insulation material over the entire outer side of a wall having an opening formed therein, the cost of heating or air-conditioning being reduced by additionally installing an insulation material in the wall so as to maintain an indoor temperature constant, and the construction being simple and costing less.

Although the present invention has been described with reference to the preferred embodiments, it is to be understood that various modifications or changes can be made without departing from the technical spirit and the scope of the invention as disclosed in the accompanying claims by those skilled in the art. Therefore, the scope of the present invention should be interpreted by the following claims, which have been set forth so as to include such various changes.

What is claimed is:

1. A window frame insulation method for reducing heat loss through a window frame area or its vicinity, the method comprising:

preparing placement by providing a mold configured to form a wall member with the mold, the wall member including a through opening formed in a portion of the wall, wherein the mold is fabricated to form a stepped portion at an outer side area of the wall along an upper side and two lateral sides, and except a lower side, of the opening;

casting concrete in the mold in order to form the wall;

curing the concrete;

installing a window frame to an inner side of the opening in the wall;

installing an insulation material to an external area of the wall along the stepped portion excluding the window frame;

installing a stepped insulation material to the stepped portion; and installing a sheathing material to an outer side of the installed insulation material, wherein the stepped portion is formed to an extent equivalent to a sum of a thickness of the insulation material and a thickness of the sheathing material and such that it has a depth that allows a stepped insulation material to be positioned further toward an indoor area than the window frame when the insulation material is installed to the stepped portion, wherein the stepped insulation material installed to the stepped portion has an L-shaped cross-section with a concave groove formed therein, and wherein the sheathing material has a stepped sheathing material portion extending in a perpendicular direction from an end face of the sheathing material, and the stepped sheathing material portion is installed to an outer side of the stepped insulation material so as to cover an end face of the insulation material and the entire concave groove of the stepped insulation material, wherein the stepped sheathing material portion is installed to a side surface of the window frame so as to be parallel to the window frame in order to protect the stepped insulation material installed to the stepped portion and such that a gap between the window frame and the stepped sheathing material portion is caulked in order to prevent convective or radiative heat transfer from occurring through the insulation material, wherein the stepped insulation material is inserted into the mold, and concrete is then casted into the mold so that the stepped insulation material is disposed in the concrete.

* * * * *